US006239681B1

(12) United States Patent
Buswell

(10) Patent No.: US 6,239,681 B1
(45) Date of Patent: May 29, 2001

(54) WIRE CORE FOR INDUCTION COILS

(76) Inventor: Harrie R. Buswell, 132 Lorraine Ct., Berea, KY (US) 40403

( * ) Notice: Subject to any disclaimer, the term of this patent is extended or adjusted under 35 U.S.C. 154(b) by 0 days.

(21) Appl. No.: 09/203,105

(22) Filed: Nov. 30, 1998

(51) Int. Cl.[7] ..... H01F 27/02; H01F 27/24

(52) U.S. Cl. ..... 336/83; 336/233; 336/60; 29/602.1

(58) Field of Search ..... 336/83, 233, 60, 336/234; 29/606, 607, 609, 602.1

(56) References Cited

U.S. PATENT DOCUMENTS

| | | | | |
|---|---|---|---|---|
| 414,266 | * | 11/1889 | Thomson | 336/234 |
| 499,852 | * | 6/1893 | Pfannkuche | 336/234 |
| 619,760 | * | 2/1899 | Kinrade | 336/234 |
| 1,597,901 | * | 8/1926 | Kent | 336/234 |
| 2,043,346 | * | 6/1936 | Buckley | 336/234 |
| 2,179,661 | * | 11/1939 | Jones | 336/234 |
| 3,304,599 | * | 2/1967 | Nordin | 336/83 |
| 3,350,670 | * | 10/1967 | Strauch | 336/234 |
| 3,720,897 | * | 3/1973 | Feather et al. | 336/60 |
| 4,035,751 | * | 7/1977 | Waltnew | 336/60 |

FOREIGN PATENT DOCUMENTS

| | | | | |
|---|---|---|---|---|
| 352251 | * | 4/1922 | (DE) | 336/83 |

* cited by examiner

*Primary Examiner*—Anh Mai
(74) *Attorney, Agent, or Firm*—King & Schickli PLLC

(57) ABSTRACT

The core for an induction coil is formed of a plurality of parallel wires that extend through the induction coil, and beyond the coil. The ends of the wires are formed around the induction coil, and the ends of the wires meet and are connected to form a complete magnetic circuit. The induction coil may be a transformer with two or more windings, or a choke coil with only one winding, or other induction coil. The electric winding may be wound directly onto the wire core, or may be formed separately and then placed on the core. A stud or the like may be bound into the core and used as a mount for the induction coil; and, cooling tubes and large rods for support may be incorporated into the core.

15 Claims, 2 Drawing Sheets

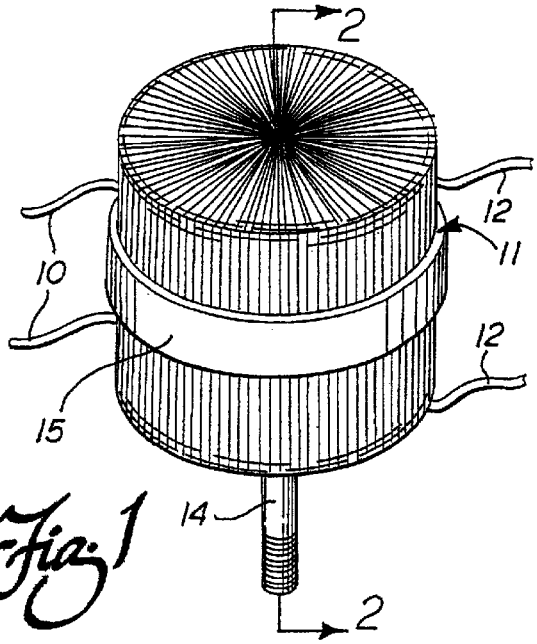
Fig. 1
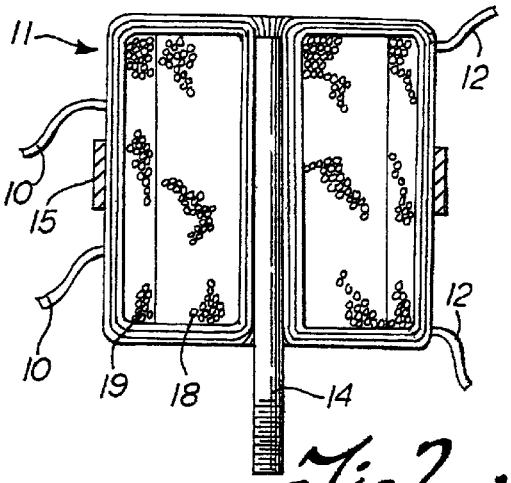
Fig. 2
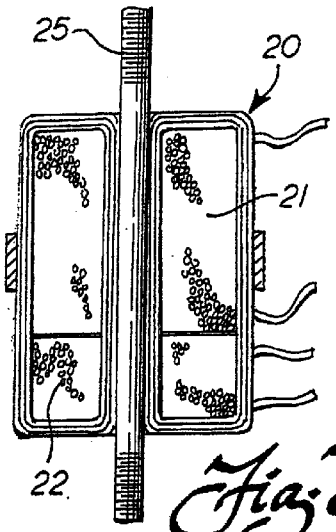
Fig. 3
Fig. 4a
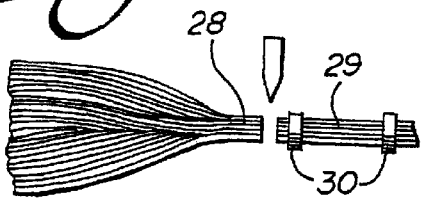
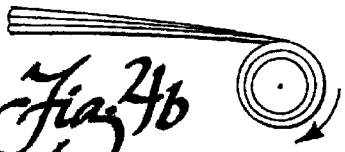
Fig. 4b
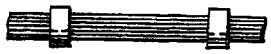
Fig. 4c
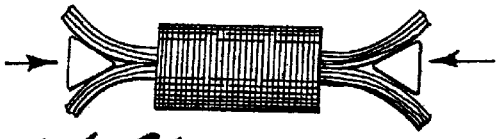
Fig. 4e
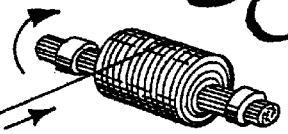
Fig. 4d

WIRE CORE FOR INDUCTION COILS

BACKGROUND OF THE INVENTION

1. Field of the Invention

This invention relates generally to induction coils, and is more particularly concerned with a wire core for induction coils such as transformers, chokes and the like.

2. Discussion of the Prior Art

It is common for transformers and other induction devices to be made up of a core comprising a plurality of sheets of steel, the sheets being die cut and stacked to create the desired thickness of a core. The individual sheets are varnished or otherwise electrically insulated from one another in order to reduce eddy currents in the core, and the thickness of the individual sheets is selected to minimize eddy currents.

The core of a transformer or the like generally passes through the center of the electric winding, and closes on itself to provide a closed magnetic circuit. Since the core then supports the electric winding, it is natural that the core has been used as the support for the transformer. That is to say, one attaches the core to a container or baseboard in order to support the transformer.

Transformers and other induction coils inherently generate heat, and the heat must be dissipated or the power characteristics of the device will change. If the device becomes too hot, the electric winding can become short circuited and burn out the coil. In small devices, one usually relies on air cooling, sometimes with metal fins or the like to assist in dissipating the heat. In larger devices, the coils and core may be immersed in oil. One then may use fins on the container, radiator pipes, or both, so convection currents move the heated oil through the cooling fins or pipes. If further cooling is needed, one generally resorts to fans to move more air across the cooling means.

When a stack of metal sheets is used as the core for an induction coil, it is usual to provide a shape, such as an E with the electric winding on the center leg of the E. After the coil is in place, in additional stack of sheets is applied to connect the ends of the E, thereby completing the magnetic circuit. Using such a technique, it will be understood that the coil is necessarily wound separately, and subsequently placed on the core. The coil must therefore be big enough to slip onto the core. Such construction contributes to the inherent noisiness of an induction coil, because the electric winding must be somewhat loose on the core. As a result, when an alternating voltage is applied to the electric winding, the sheets making up the core tend to vibrate with the alternating magnetic field. Any gaps and spaces between the electrical components and the magnetic components reduce coupling and efficiency of action.

SUMMARY OF THE INVENTION

The present invention provides a core for induction coils, the core comprising a plurality of wires bundled to make up the needed core. The electric winding is either wound directly onto the bundle of wires, or is wound separately and slipped over the core. After the electric winding is in place, the ends of the wires making up the core are spread and formed over the winding, the two ends of the wires meeting to form a complete magnetic circuit. A band or other connector means can hold the ends together.

In one embodiment of the invention, the core may include a screw bound into the core and extending therefrom as a mounting means for the induction coil. The screw may extend from either one side or both sides as desired. Also, the make-up of the core may be otherwise varied considerably. Wires of various diameters may be used to achieve greater density of the core; a few large wires may be spaced around the core to provide rigidity; and, one or more tubes may be incorporated into the core, the tubes carrying a heat exchange fluid for cooling the induction coil. The cooling tubes are preferably of non-magnetic and non-electrical-conducting material.

BRIEF DESCRIPTION OF THE DRAWINGS

These and other features and advantages of the present invention will become apparent from consideration of the following specification when taken in conjunction with the accompanying drawings in which:

FIG. 1 is a perspective view of a transformer made in accordance with the present invention;

FIG. 2 is a diametrical cross-sectional view taken through the device shown in FIG. 1;

FIG. 3 is a view similar to FIG. 2 but showing a modified form of the invention;

FIGS. 4A–4E are schematic illustrations showing steps in the method for making an induction coil in accordance with the present invention;

DETAILED DESCRIPTION OF THE EMBODIMENTS

Figure 5:
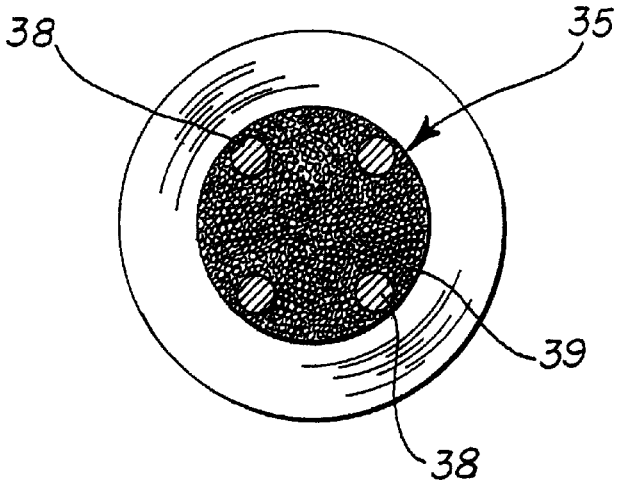
FIG. 5 is a cross-sectional view taken perpendicularly to the core in a device as shown in FIG. 1, but showing a modified form of core; and, FIG. 6 is a view similar to FIG. 5 but showing another modified form of core.

Referring now more particularly to the drawings and to those embodiments of the invention here presented by way of illustration, FIG. 1 shows a transformer having leads 10 for connecting a power source to the primary winding of the transformer 11, and leads 12 for connecting the secondary winding to a load. Those skilled in the art will realize that designation of primary and secondary is somewhat arbitrary, and that one may use the leads 12 for connection to the primary winding, and the leads 10 for connection to a load. The designations of "primary" and "secondary" are therefore used herein as a convenience, and it should always be remembered that the windings are reversible.

A threaded stud 14 extends from the bottom of the transformer 11, the stud 14 providing a convenient mounting means for the transformer. The transformer 11 is covered on its exterior surface with wires; and, as will be discussed in more detail below, the wires terminate beneath the band 15, the band 15 serving to hold the ends of the wires in place. The leads 10 and 12 pass between the wires to connect to the electric windings of the transformer.

Looking at FIG. 2 in conjunction with FIG. 1, it can be seen that the core 16 of the transformer 11 is made up of a plurality of wires rather than the conventional sheets of steel. As is usual, however, the windings 18 and 19 are received on the core. In FIG. 2 it can be seen that the wires of the core extend outwardly from the core, and pass around the windings 18 and 19 to envelop the windings. The ends of the wires of the core meet, and are held together by the band 15.

Centrally of the core 16, the stud 14 is held in place simply by being embedded within the wires of the core 16. The stud 14 can therefore act as a mounting means for the transformer. Of course the stud 14 may support the transformer 11 from below, as illustrated in FIGS. 1 and 2, or the stud 14 may extend from the top of the transformer 11 with the transformer depending from the stud 14.

In FIG. 3 of the drawings, the transformer is designated at 20. The transformer 20 is similar to the transformer 11, but the electrical windings 21 and 22 are beside each other on the core 24 instead of one upon the other as in the transformer 11. Also, the stud 25 extends from both the top and bottom of the transformer 20. The transformer 20 may be mounted from either top or bottom, or from both.

While the use of the stud 14 or 25 is a convenient mounting means for a transformer, one may wish to utilize the transformer of the present invention in a conventional setting, wherein the stud is not convenient. The conventional transformer is typically supported by the core structure. Since the core of the present invention is not adapted to provide similar support, one might utilize the stud 14 or 25 to fix the transformer to a bracket that can be mounted as a conventional transformer. Alternatively, the central core area may have no stud, but be filled with core wires with mounting secured by other means, such as external strapping.

It is believed that the use of a core made up of a plurality of wires will yield an efficient manufacturing system as well as yielding a superior transformer. FIG. 4*a* shows schematically one technique for forming a core. In FIG. 4*a* a plurality of wires, as from a creel, is brought together into a bundle 28 for forming a core. The bundle is held together, a predetermined length measured, and the bundle is cut to form one core 29. Bands 30 or other means may hold the wires together. It will be recognized that the wires from the creel may be of a single thickness, or may be of multiple thicknesses. The use of multiple thicknesses will allow a more dense packing of the core for better magnetic characteristics, but the use of a single thickness of wires will also provide an acceptable core.

FIG. 4*b* illustrates a modified method for forming a core in accordance with the present invention. In the method shown in FIG. 4*b* one wire or a plurality of wires can be fed to a winder, so that a coil is formed. Since a winder of this type may be very high speed, it would be practicable to use a single, very thin wire to form the core. However, one may also use a variety of sizes of wires, the wires being geometrically sized and arranged to be densely packed.

Once the coil is formed, the coil will be cut, and the wires straightened as in FIG. 4*c*. By appropriately deforming the coil before cutting, the ends of the bundle will be substantially square. Bands or the like will hold the core together, as in FIG. 4*a*.

After a core is formed, by any method, the electric winding is to be placed on the core. One may, in accordance with the prior art, wind a coil and then slip the coil over the core. The present invention, however, provides for an alternative method wherein the electric winding is wound directly onto the core, as shown in FIG. 4*d*. One advantage of the direct winding is that it is more efficient to wind the electric winding directly on the steel core, thereby eliminating a step in the manufacture. Another advantage is that, by winding the electric winding directly onto the core, the electric winding will assist in binding the wires of the core tightly together, thereby offering several mechanical and electrical advantages, including tighter magneto-electric coupling and also reducing the possibility of noise from the core.

With the electric winding in place on the core, the next step is to form the wires of the core around the electric windings. FIG. 4*e* illustrates the forming of the wires of a core, for example by using a pair of cones to spread the wires generally radially. Conventional means may then be used to form the wires completely around the electric windings so the core wires are shaped as shown in FIGS. 1–3.

Those skilled in the art will recognize that the core of an induction coil preferably forms a closed magnetic circuit. The forming of the wires of the core around the electric winding causes the two ends of the core wires to meet. Such wires will be prepared by having their ends cleaned; then, when the ends of the wires meet, they are held together by the band 15 or other connection means.

In addition to providing the desired closed magnetic circuit, it will be seen that the entire transformer 11 or 20 is covered by the steel wires, so the transformer is effectively completely shielded. The transformer of the present invention may therefore be used in electrically noisy environments without ill effects.

Figure 6:
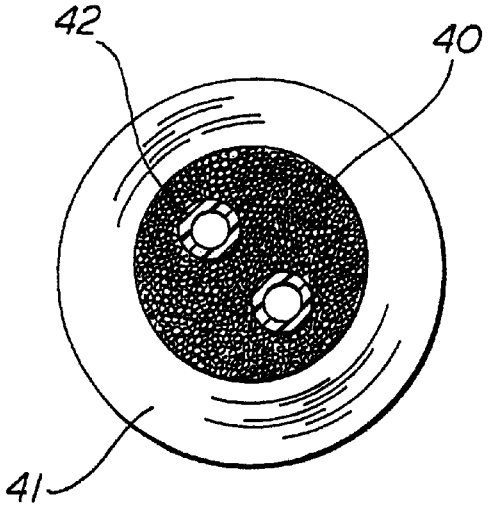

Further variations on the core of the present invention are shown in FIGS. 5 and 6 of the drawings. FIG. 5 illustrates a core 35 having an electric winding 36 therearound. The core 35 is made up of four large wires, or rods, 38, and a large number of smaller wires 39. This embodiment of the invention provides the large wires 38 as structural members on which the entire device may be supported, with the small wires to provide the above discussed advantages.

FIG. 6 illustrates a transformer on the like having a core 40 and an electric winding 41. The core 40 includes a plurality of tubes 42 extending therethrough. The tubes 42 are here illustrated as being made of a polymeric material, but they may be made of other non-magnetic material. The use of the tubes 42 provides direct cooling of the core, which is much more efficient than the secondary cooling by passing a fluid over the outside of the transformer.

It will therefore be understood that the present invention provides a highly efficient method for making an induction coil and a highly efficient induction coil. It should be noted that the core wires of the present invention would be made of substantially the same silicon and other steel that is used for conventional cores. Furthermore, the process of drawing the wire produces the same desirable grain structure—and in the proper direction—as is found in the present stamped sheets. The wires of the present invention will be coated to be electrically insulated from one another to reduce eddy currents, and the diameter of the wires will be selected to reduce eddy currents. For many years the thickness (thus number of necessary pieces) of the stampings has been determined by a strict set of constraints—magnitude of eddy currents versus number of necessary pieces.

While the specific embodiments of the invention here presented are transformers, it will be understood by those skilled in the art that the same techniques and the same results are applicable to choke coils and other induction coils. Also, the electric windings may be in any physical arrangement desired, including as a floating coil for auto transformers and the like.

It will therefore by understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

What is claimed as invention is:

1. An inductive device comprising:

a magnetic core formed of a plurality of wires, said wires each having first and second ends;

at least one electric winding wound directly on said magnetic core;

wherein said first and second ends of said plurality of wires extend around said at least one electric winding and connect together substantially enveloping said magnetic core and said at least one electric winding and forming a complete magnetic circuit; and wherein said plurality of wires includes wires of at least two different diameters to increase the density of said magnetic core, whereby the magnetic characteristics and overall efficiency of the inductive device are improved.

2. The inductive device of claim 1, wherein said plurality of wires forming said magnetic core includes wires of at least three different diameters to increase the density of said magnetic core.

3. The inductive device of claim 2 further comprising a mounting post held within said magnetic core and extending therefrom for supporting the inductive device.

4. The inductive device of claim 2 further comprising at least one tube intermingled within said plurality of wires for carrying a fluid for removing heat from within the inductive device.

5. A transformer comprising:

a magnetic core formed of a plurality of wires, said wires each having first and second ends;

at least two electric windings surrounding said magnetic core, at least one of said windings securely binding said magnetic core; and wherein said first and second ends of said plurality of wires extend around said at least two electric windings and are connected together substantially enveloping said magnetic core and said at least two electric windings and forming a complete magnetic circuit.

6. The transformer of claim 5, wherein said at least two electric windings include primary and secondary windings;

said primary winding directly contacting said magnetic core; and said secondary winding wound on said primary winding.

7. The transformer of claim 6 further comprising at least one non-magnetic tube intermingled within said plurality of wires for carrying a fluid for removing heat from within the transformer.

8. The transformer device of claim 6, wherein said plurality of wires forming said magnetic core includes wires of at least two different diameters to increase the density of said magnetic core, whereby the magnetic characteristics and overall efficiency of the transformer are improved.

9. The transformer device of claim 8, wherein said plurality of wires forming said magnetic core includes wires of at least three different diameters to increase the density of said magnetic core.

10. The transformer of claim 8, wherein said at least two electric windings include primary and secondary windings directly contacting and securely binding said magnetic core.

11. The transformer of claim 8 further comprising a mounting post held within said plurality of wires and extending therefrom for supporting the transformer.

12. A method for making a transformer, comprising the steps of:

forming a magnetic core of a plurality of wires;

securely binding said core along its length with at least two electric windings, at least one of said windings directly contacting said core;

forming said plurality of wires over said at least two electric windings to envelop said windings and form a complete magnetic circuit.

13. The method for making a transformer according to claim 12, wherein the forming step includes intermingling a first group of wires having a first diameter with a second group of wires having a different diameter to increase the density of said magnetic core.

14. The method for making a transformer according to claim 13, wherein the step of binding said core with at least two electric windings includes winding first and second electric windings directly on said magnetic core.

15. The method for making a transformer according to claim 13, wherein the step of binding said core with at least two electric windings includes winding a second electric winding directly on said first electric winding.

* * * * *